US012241227B2

(12) United States Patent
Tanaka et al.

(10) Patent No.: US 12,241,227 B2
(45) Date of Patent: Mar. 4, 2025

(54) SYSTEM, METHOD, AND MACHINE FOR ENGINE RESTARTING BY JOYSTICK OPERATION

(71) Applicant: Caterpillar SARL, Geneva (CH)

(72) Inventors: Kensuke Tanaka, Akashi (JP); Atsunori Shimamoto, Akashi (JP); Takashi Kotera, Akashi (JP)

(73) Assignee: Caterpillar SARL, Geneva (CH)

( * ) Notice: Subject to any disclaimer, the term of this patent is extended or adjusted under 35 U.S.C. 154(b) by 242 days.

(21) Appl. No.: 17/896,088

(22) Filed: Aug. 26, 2022

(65) Prior Publication Data

US 2024/0068200 A1 Feb. 29, 2024

(51) Int. Cl.

| | |
|---|---|
| ***E02F 9/20*** | (2006.01) |
| ***E02F 9/22*** | (2006.01) |
| ***E02F 9/24*** | (2006.01) |
| ***E02F 9/26*** | (2006.01) |

(52) U.S. Cl.

CPC ..... *E02F 9/2025* (2013.01); *E02F 9/2004* (2013.01); *E02F 9/2066* (2013.01); *E02F 9/226* (2013.01); *E02F 9/24* (2013.01); *E02F 9/26* (2013.01)

(58) Field of Classification Search

CPC ..... E02F 9/2025; E02F 9/2004; E02F 9/2066; E02F 9/226; E02F 9/24; E02F 9/26

See application file for complete search history.

(56) References Cited

U.S. PATENT DOCUMENTS

| | | | | |
|---|---|---|---|---|
| 7,500,535 | B2 | 3/2009 | Kamon et al. | |
| 2003/0112219 | A1* | 6/2003 | Gharsalli | E02F 3/84 345/156 |
| 2006/0179830 | A1* | 8/2006 | Kamon | F02N 11/10 60/431 |
| 2018/0238024 | A1* | 8/2018 | Takigawa | F02D 29/06 |
| 2021/0079624 | A1* | 3/2021 | Kodaka | E02F 9/24 |

FOREIGN PATENT DOCUMENTS

| | | |
|---|---|---|
| EP | 3581715 | 12/2019 |
| JP | 3797805 B2 | 7/2006 |
| JP | 3825289 B2 | 9/2006 |

(Continued)

OTHER PUBLICATIONS

WO-2005064170-A1 machine translation.*

(Continued)

*Primary Examiner* — Hussein Elchanti
*Assistant Examiner* — Oliver Tan

(57) ABSTRACT

A work machine comprises a joystick to control a movement of the work machine, a lock lever to control a hydraulic system of the work machine, a display to output information to an operator inside the work machine, and processing circuitry. The processing circuitry is configured to lock the hydraulic system without receiving an input from the lock lever, perform an idling stop operation of an engine of the work machine, output, on the display, an instruction for the operator to operate the joystick to restart the engine of the work machine, detect a predetermined operation of the joystick, perform an engine restart operation, under a condition that the predetermined operation of the joystick is detected, and unlock the hydraulic system without receiving the input from the lock lever.

20 Claims, 8 Drawing Sheets

(56) References Cited

FOREIGN PATENT DOCUMENTS

| | | | | |
|---|---|---|---|---|
| JP | 4010255 | B2 | 11/2007 | |
| JP | 4089270 | B2 | 5/2008 | |
| JP | 4271685 | B2 | 6/2009 | |
| JP | 2017072038 | A | 4/2017 | |
| WO | 2005/054649 | A1 | 6/2005 | |
| WO | WO-2005064170 | A1 * | 7/2005 | ..... E02F 9/24 |

OTHER PUBLICATIONS

Written Opinion and International Search Report for Int'l. Patent Appln. No.PCT/EP2023/025382, mailed Nov. 7, 2023 (11 pgs).

* cited by examiner

SYSTEM, METHOD, AND MACHINE FOR ENGINE RESTARTING BY JOYSTICK OPERATION

TECHNICAL FIELD

The present disclosure relates to work machines, and more particularly to construction machines having joysticks for control of engine restart, and systems, assemblies, and methods thereof.

BACKGROUND

Certain types of construction machines may provide an automatic stop function which can automatically stop an engine upon a predetermined automatic stop condition (such as a condition that an operation lever adapted to operate a work actuator is not being operated).

Japanese Patent JP3825289B2 ("the JP '289 Patent") describes an engine control device for a work machine that can perform idling stop operation or restart operation to an engine without manipulating a key switch. According to the JP '289 Patent, the engine can be restarted by operating a control lever by an operator of the work machine or by operating a one-touch operation button type switch implemented on the control lever, without manipulating the key switch.

On the other hand, the construction machines may have a lock lever capable of switching a hydraulic circuit to an operable state or an inoperable state, and the engine may be also stopped by operating the lock lever.

It has been desired to be able to restart the engine of the work machine with satisfying a usability condition of the control lever and the lock lever as well as a safety condition. It may also be desirable to restart the engine without having to push a Push-to-Start (PTS) button.

SUMMARY

According to an aspect a work machine is described or provided. The work machine can comprise a joystick to control a movement of the work machine, a lock lever to control a hydraulic system of the work machine, a display to output information to an operator inside the work machine, and processing circuitry. The processing circuitry can be configured to lock the hydraulic system without receiving an input from the lock lever, perform an idling stop operation of an engine of the work machine, output, on the display, an instruction for the operator to operate the joystick lever to restart the engine of the work machine, detect a predetermined operation of the joystick, perform an engine restart operation, under a condition that the predetermined operation of the joystick is detected, and unlock the hydraulic system without receiving the input from the lock lever.

In another aspect, a method for a work machine is disclosed or implemented. The method can comprise outputting, on a display of the work machine, an instruction for an operator to operate an operation lever to restart the engine of the work machine, after an idling stop operation, the operation lever controlling movement of the work machine, detecting a predetermined operation of the operation lever, while a hydraulic system being locked without a first input to the lock lever, the first input being a first physical input to lock the hydraulic system by the lock lever, performing an engine restart operation, determining that the operation lever is in a neutral position, and unlocking the hydraulic system without a second input from the lock lever, the second input being a second physical input to unlock the hydraulic system by the lock lever.

And in another aspect a non-transitory computer-readable storage medium is disclosed or provided. The non-transitory computer-readable storage medium can comprise computer executable instructions, wherein the instructions, when executed by an information processing system of a work machine, cause the information processing system to perform a method, the method comprising, locking a hydraulic system without a first mechanical input, performing an idling stop operation of an engine of a work machine, determining a predetermined operation of an operation lever in response to output information an instruction for an operator to operate the operation lever to restart the engine of the work machine, performing an engine restart operation, under a condition that the predetermined operation of the operation lever is determined, and unlocking the hydraulic system without a second mechanical input.

Other features and aspects of this disclosure will be apparent from the following description and the accompanying drawings.

DETAILED DESCRIPTION

The present disclosure relates to work machines, and more particularly to construction machines having joysticks for control of engine restart, and systems, assemblies, and methods thereof. Generally, embodiments of the disclosed subject matter can implement the work machine that can lock a hydraulic system by software during idling stop operation, regardless of a position of a lock lever, and furthermore can restart the engine by detecting a predetermined operation of a joystick lever, for instance, to satisfy the safety condition and usability of the work machine.

Figure 1:
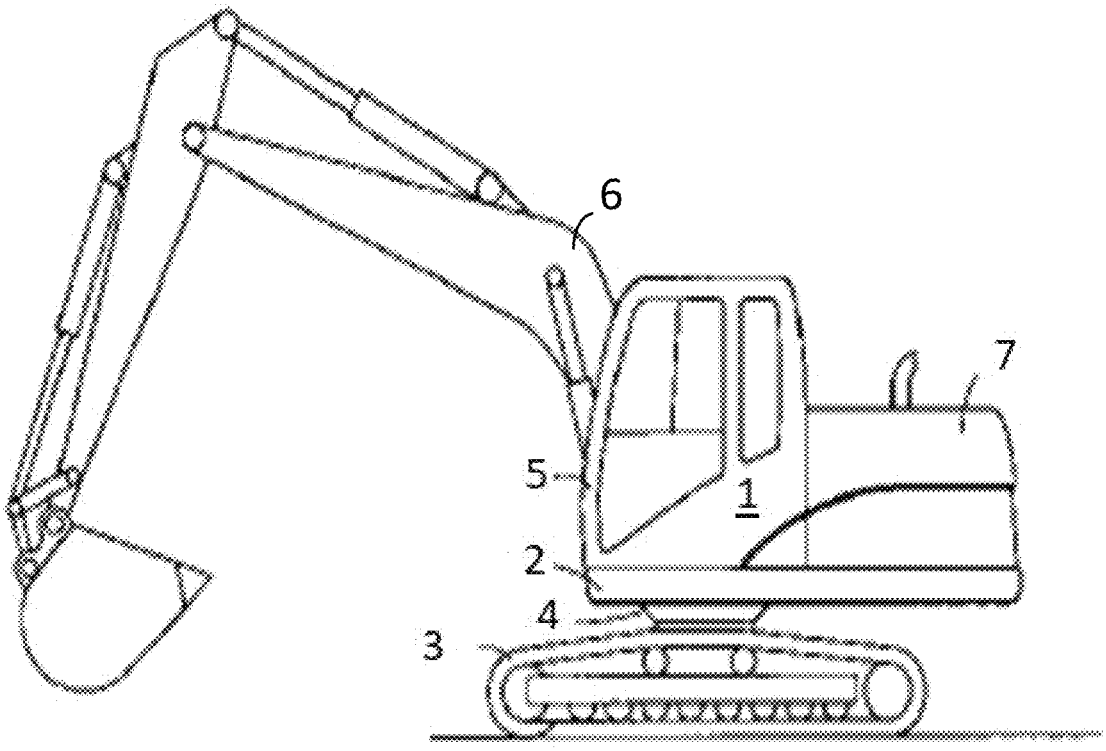
FIG. 1 is a side view of an excavator as example of a work machine according to one or more embodiments of the disclosed subject matter.

Turning to the figures, FIG. 1 shows a hydraulic excavator as a work machine 1, according to one or more embodiments of the disclosed subject matter, though embodiments of the disclosed subject matter are not so limited to hydraulic excavators. Regarding the work machine 1, an upper swing body 2 can be rotatably provided as a machine body on a lower traveling body 3, via a swing bearing portion 4. A cab 5 can be mounted on one side of a front part of the upper swing body 2, and a driver's seat, an operation lever, a foot pedal, and other components can be installed in the cab 5.

Furthermore, a boom 6 for excavation work can be mounted on the other side of the front part of the upper swing body 2. An engine 11 (shown in FIG. 2) and a power device such as a hydraulic pump which is driven by the engine can be mounted on the rear part of the upper swing body 2 and covered with a power device cover 7.

Figure 2:
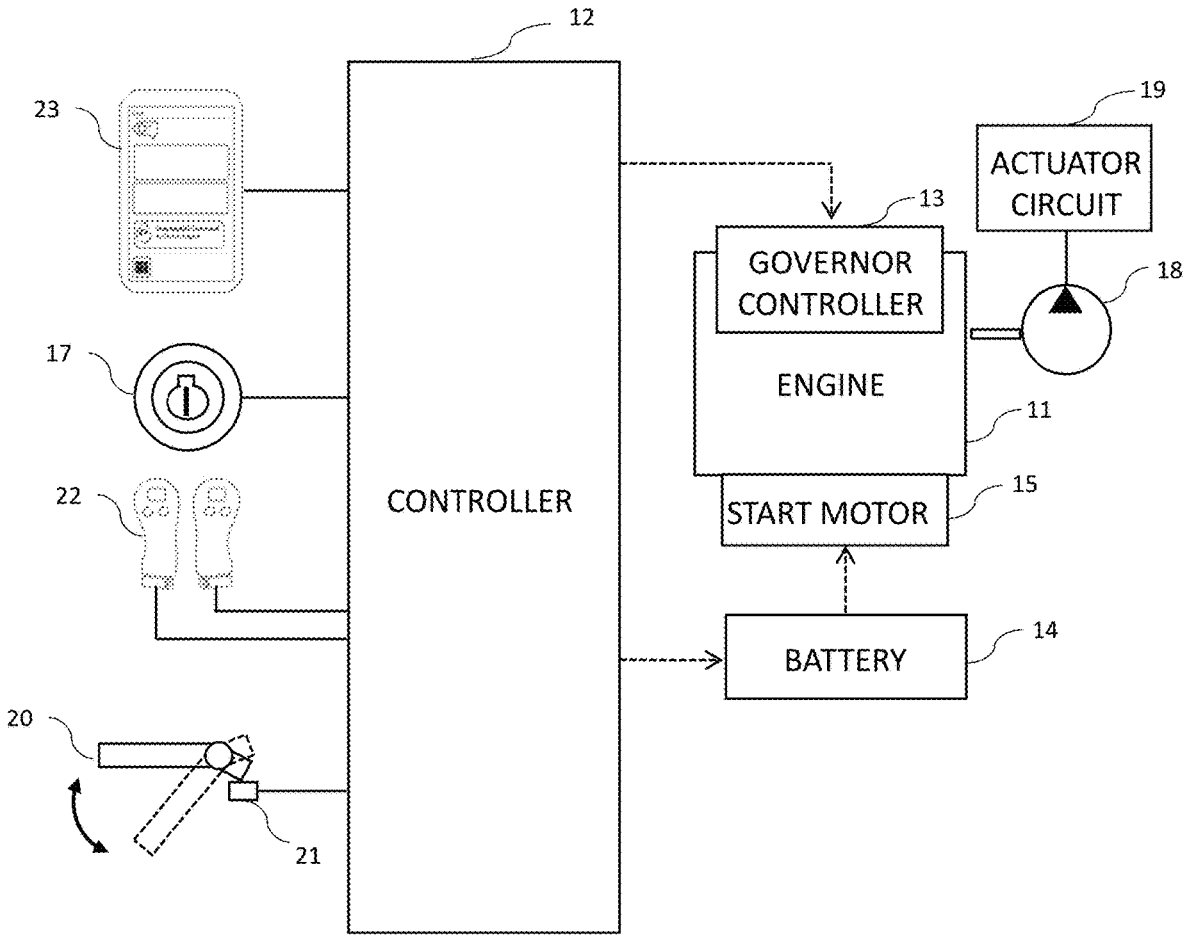
FIG. 2 is a schematic illustration of a system according to one or more embodiments of the disclosed subject matter implementable on work machines according to embodiments of the disclosed subject matter.

FIG. 2 shows a schematic illustration of a system of the work machine 1 shown in FIG. 1 according to one or more embodiments of the disclosed subject matter. As shown in FIG. 2, the engine 11 serving as a power source can be controlled by a controller 12 which may control start, stop, and a rotational speed of the engine 11. The start of the engine 11 can be controlled by a control signal from the controller 12 via a governor controller 13, for instance, as well as a general circuit to supply power from a battery 14 to a starter motor 15 that starts the engine 11 via a start switch 17. The controller 12 in FIG. 2 can perform an idling stop operation so that the engine 11 can be automatically stopped, for instance, when the work machine 1 is in an idle state continuously for a predetermined time or longer.

A hydraulic pump 18 is rotationally driven by the engine 11, and pressure oil discharged from the hydraulic pump 18 is delivered to various hydraulic actuators (for example, hydraulic cylinders of an arm and a bucket mounted at the end of the boom 6, and hydraulic motors of the upper swing body 2 and the lower traveling body 3 of the work machine 1) via an actuator circuit 19. The hydraulic actuators and the hydraulic motors for the work machine 1 can be controlled by a control signal from the controller 12 by operating a lock lever 20.

The lock lever 20 may be a lever to operate the hydraulic system of the work machine 1. The lock lever 20 shown in FIG. 2 can be implemented in the cab 5 shown in FIG. 1, and the operator of the work machine 1 can move the lock lever 20 from a lock position (i.e., a lock state) to a lock release position (i.e., an unlock state) by hand. In particular, the controller 12 may detect a lock release signal by a limit switch 21 and allow control of the hydraulic actuators to be operated when the lock lever 20 is in the lock release position. On the other hand, when the lock lever 20 is in the lock position, the controller 12 may implement control so that the operation of the hydraulic actuators is stopped. In other words, the controller 12 can control the operation of a hydraulic lock valve so as to activate the hydraulic lock upon the lock lever 20 being opened (locked state), and to release the hydraulic lock upon the lock lever 20 being closed (unlocked state) as described above based upon a signal from the limit switch 21.

Optionally or alternatively, the lock lever 20 can serve as a gate lever which may block the operator from getting in and out to the cab 5 in the unlock state, while the lock lever 20 can allow the operator to get in and out to the cab 5 in the lock state.

The start switch 17 may be a switch to turn on and off electric power supplied to the engine 11 during a normal operation. The start switch 17 shown in FIG. 2 can be implemented in the cab 5 shown in FIG. 1. Optionally or alternatively, the start switch 17 can be implemented as a Push-to-Start (PTS) button which can require the operator to perform a two-step operation including rotation of the PTS button then pressing the center of the PTS button in order to start the engine 11 safely. More specifically, the operator may rotate the PTS button from a "OFF" position to a "START" position, then a message to press the PTS button may be shown on an operator interface 23. In response to the message, the operator may press the center of the PTS button, so that an engine start command signal is transmitted to the starter motor 15 via the controller 12, and the engine 11 is eventually started. Here, it may be not useful to the operator to operate the start switch 17 each time restarting the engine 11 after the idling stop operation.

Joystick lever(s) 22 may be a control lever to operate movement of the work machine 1, such as rotation movement of the upper swing body 2 and driving movement of the lower traveling body 3. The joystick lever(s) 22 shown in FIG. 2 can be implemented in the cab 5 shown in FIG. 1. As an example, the work machine 1 may include a set of two joystick levers 22 for both hands as shown in FIG. 2.

In this embodiment, the joystick levers 22 can be also used to control restart of engine 11 by imputing a predetermined operation after engine shutdown. For instance, if the controller 12 detects that an input from either one of the two joystick levers 22 is more than 75% (i.e., tilt) for a predetermined amount of time (e.g., one second or more), the controller 12 may determine the input as the predetermined operation. The implementation of restart of the engine 11 by an input from the joystick lever 22 will be described with reference to FIGS. 5-8.

The operator interface 23 may be a control panel, for instance, implemented on or as a display device operative to display, for instance, a graphical user interface (GUI) providing some or all of the operator interface 23. The operator interface 23 can be (or can be part of) a touch panel to display a keypad and/or selectable contents on a screen to receive input from the operator of the working machine 1. Such operator interface 23, according to embodiments of the disclosed subject matter, may be implemented using multiple display devices. In this embodiment, the operator interface 23 may indicate information of the state (or states) of the engine 11 and the hydraulic lock to the operator.

It is noted that embodiments of the disclosed subject matter are not limited to the specific arrangement of the work machine 1 as shown in FIG. 2. For instance, embodiments of the disclosed subject matter can include more elements to operate the work machine 1 and to control engine stop/restart function of the work machine 1.

Figure 3:
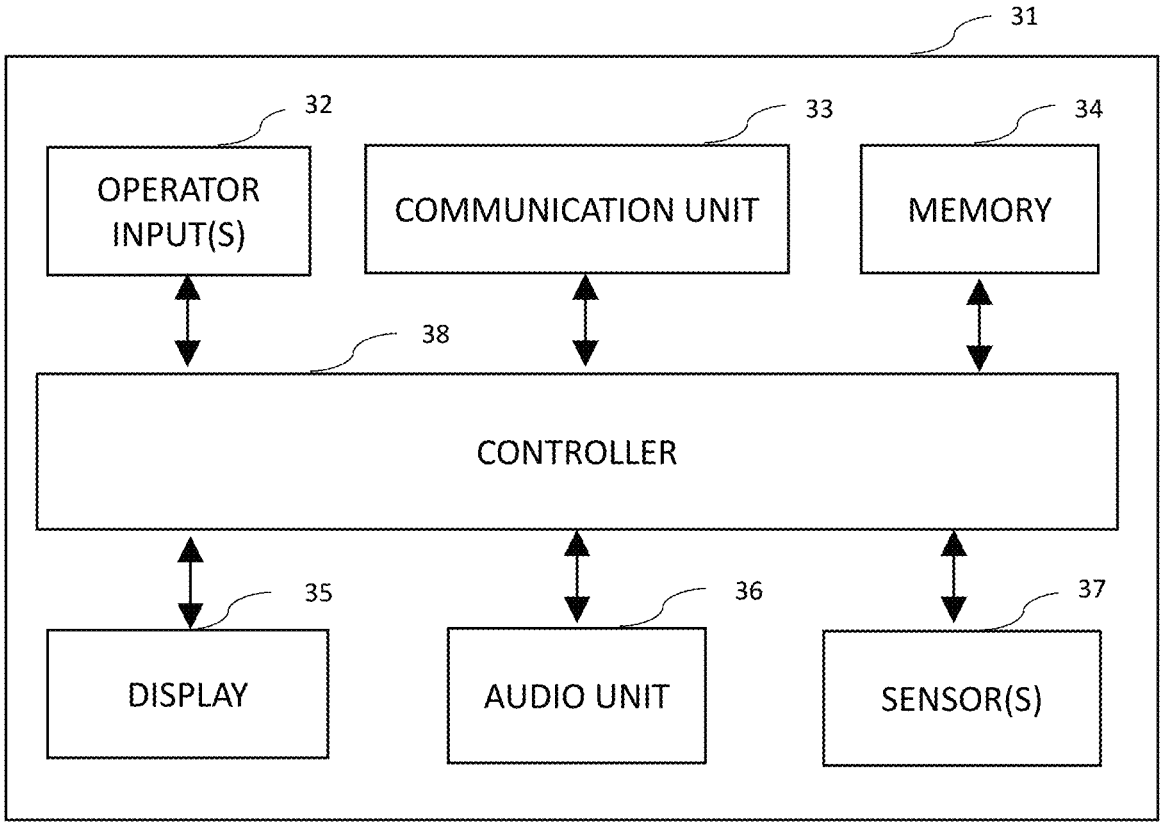
FIG. 3 is a block diagram of a control system according to one or more embodiments of the disclosed subject matter.

Turning now to FIG. 3, FIG. 3 is a block diagram of a control system 31, according to one or more embodiments of the disclosed subject matter. As illustrated in FIG. 3, the control system 31 can include a controller 38, which may be implemented in or using control circuitry, one or more operator inputs 32, a communication unit 33, memory 34, one or more displays 35, an audio unit 36 and one or more sensors 37. The controller 38, as used herein, can include only one controller or multiple controllers.

The memory 34 may be operatively coupled to the controller 38 and may reside outside of the controller 38, such as shown in FIG. 3, and/or within the controller 38, i.e., as part of the controller 38. Generally, the memory 34 can receive and save therein data or information regarding operation of the work machine 1. As an example, the memory 34 can receive and save therein setting information of the predetermined operation of the joystick lever 22.

The communication unit 33 may be (or may be part of) the communication system 31. In this regard, the communication unit 33 can include transmit circuitry to transmit information or data, such as information of the engine state and/or the hydraulic lock state, to a back office system. Optionally, the communication unit 33 can have receive circuitry to receive information or data from the back office system, for instance. In this embodiment, the communication unit 33 can be configured using a communication device such as a local CAN, a wired or wireless LAN, a communication card for Bluetooth, a router for communication, and a modem for communication.

The audio unit 36 may be comprised of one or more audio speakers, for instance, provided in the cab 5, to output audible information, such as alerts, to the operator of the work machine 1. As an example, the audio unit 36 can output an audible alert that the lock lever 22 is unlocked when the operator is getting off the cab 5. For instance, the audio unit 36 can output an audible message to urge the operator to move the joystick lever 22 to restart engine 11.

The one or more sensors 37 can detect various information of the work machine 1. For instance, the one or more sensors 37 can include a position sensor associated with rotation or swing of the work machine 1, a triaxial acceleration sensor (including an acceleration sensor, a gravity detection sensor, and a fall detection sensor) or a triaxial gyro sensor (including an angular velocity sensor, and a geomagnetic sensor). Outputs from the one or more sensors 37 may be fed back to the controller 38. Optionally, information from at least one of the one or more sensors 37 may be displayed on the display 35.

The operator input(s) 32 can be (or can be part of) the start switch 17, the lock lever 20, the joystick lever 22, and the operator interface 23. Operator input to the start switch 17 can be to transmit an engine start command signal to the starter motor 15 shown in FIG. 2 via the controller 38 to start the engine 11 shown in FIG. 2. Operator input to the lock lever 20 can be to transmit a lock release signal to the actuator circuit 19 shown in FIG. 2 via the controller 38 to control the hydraulic lock. Operator input to the joystick lever 22 can be to control operations of the work machine 1. For instance, operator input to the joystick lever 22 can control rotation or swing of the work machine 1 and can control the engine restart operation, which will be described with reference to FIGS. 4-8. Operator input to the operator interface 23 can be implemented by a touch panel equipped with the operator interface 23.

According to one or more embodiments, at least one of the one or more of the displays 35 may constitute or be part of the operator interface 23 shown in FIG. 2. In this regard, such at least one display 35 may be implemented on a display device operative to display a graphical user interface (GUI). Optionally, the one or more displays 35 may output an alert and a message to the operator of the work machine 1, for instance, information of the states of the engine 11 and the hydraulic lock to the operator.

The controller 38 can output control signaling to various system components (e.g., hydraulic systems, electrical systems, etc.) to control movement of the working machine 1 responsive to the operator input(s) 32. The controller 38 can include a CPU, a ROM, and a RAM. The controller 38 shown in FIG. 3 may correspond to the controller 12 shown in FIG. 2 and can perform various functions described with FIG. 2.

In an exemplary implementation, the control system 31 of the work machine 1, or portions thereof, can be implemented using circuitry or processing circuitry that can include general purpose processors, special purpose processors, integrated circuits, ASICs ("Application Specific Integrated Circuits"), CPU (a Central Processing Unit), a micro processing unit (MPU), conventional circuitry and/or combinations thereof which are configured or programmed to perform the disclosed functionality. Processors can be considered processing circuitry or circuitry as they include transistors and other circuitry therein. The processor may be a programmed processor which executes a program stored in a memory. In the disclosure, the circuitry, units, or means can be hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units can be a combination of hardware and software, the software being used to configure the hardware and/or processor.

Figure 4:
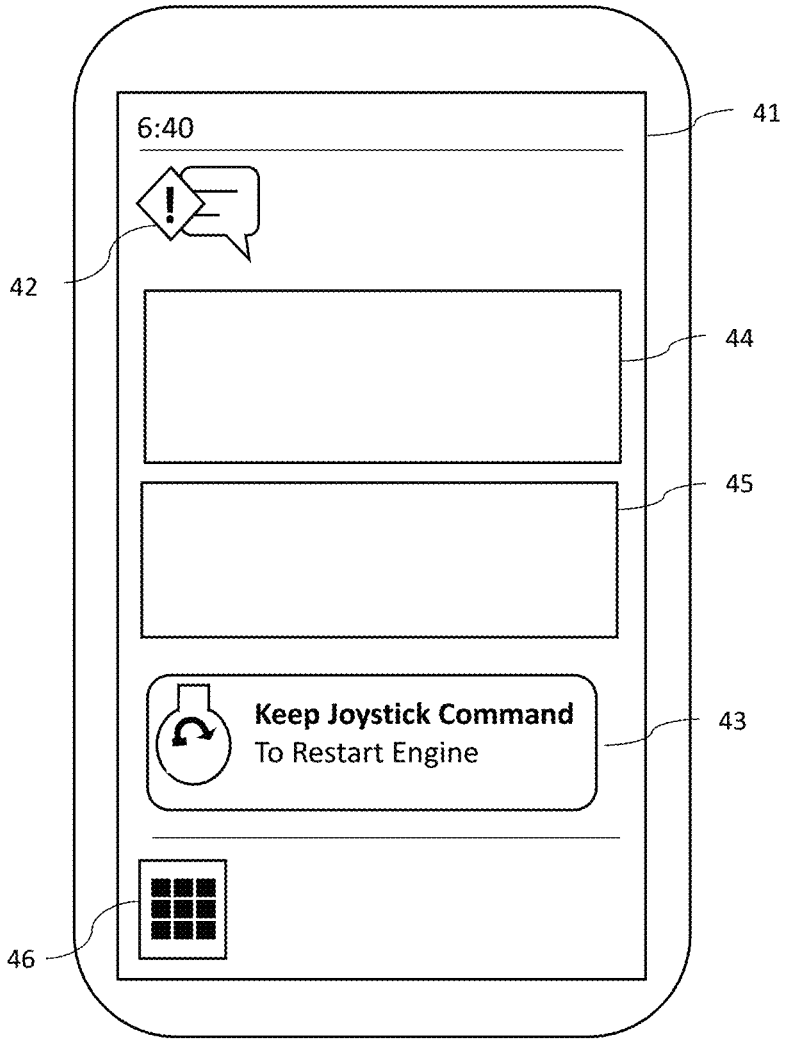
FIG. 4 shows an exemplary operator interface according to one or more embodiments of the disclosed subject matter.

Turning now to FIG. 4, FIG. 4 shows exemplary operator interface 23, which may be provided on at least one display 35, and which may be implemented on a display device operative to display a graphical user interface (GUI), according to one or more embodiments of the disclosed subject matter.

The display 35 can display a screen 41 to indicate a message to the operator of the work machine 1 to move the joystick lever 22. Here, in FIG. 4, a field 42 may show an alert message to the operator of the work machine 1.

Similarly, a field 43 can indicate a message that urges the operator of the work machine 1 to move the joystick lever 22 to restart engine during an idling stop operation.

Optionally, the screen 41 can include a menu button 46 to show menu items.

Optionally, as shown in FIG. 3, the display 35 can be equipped with the touch panel, so that the operator of the work machine 1 can input setting information and commands corresponding to the fields 42-46 to the controller 38 via the screen 41, by the touch panel of the display 35.

It is noted that embodiments of the disclosed subject matter are not limited to the specific arrangement of the fields and the buttons on the screen as shown in FIG. 4. For instance, embodiments of the disclosed subject matter can arrange the fields and the buttons in different positions or include more fields and buttons on the screen for other functions of the work machine 1.

INDUSTRIAL APPLICABILITY

As noted above, the present disclosure relates to work machines, and more particularly to construction machines having joysticks to control engine restart, and systems, assemblies, and methods thereof.

FIGS. 5-8 are flowcharts of a method of controlling an idling stop operation and a restart operation of the engine 11 of the work machine 1, according to one or more embodiments of the disclosed subject matter. Some or all of the operations of the methods can be performed by or using the controller 12 or the controller 38. Further, some or all of each of the methods can be performed via a non-transitory computer-readable storage medium (or media) having stored thereon instructions that, when executed by one or more processors (e.g., of the controller 12) causes the one or more processors to perform some or all of the method(s).

Figure 5:
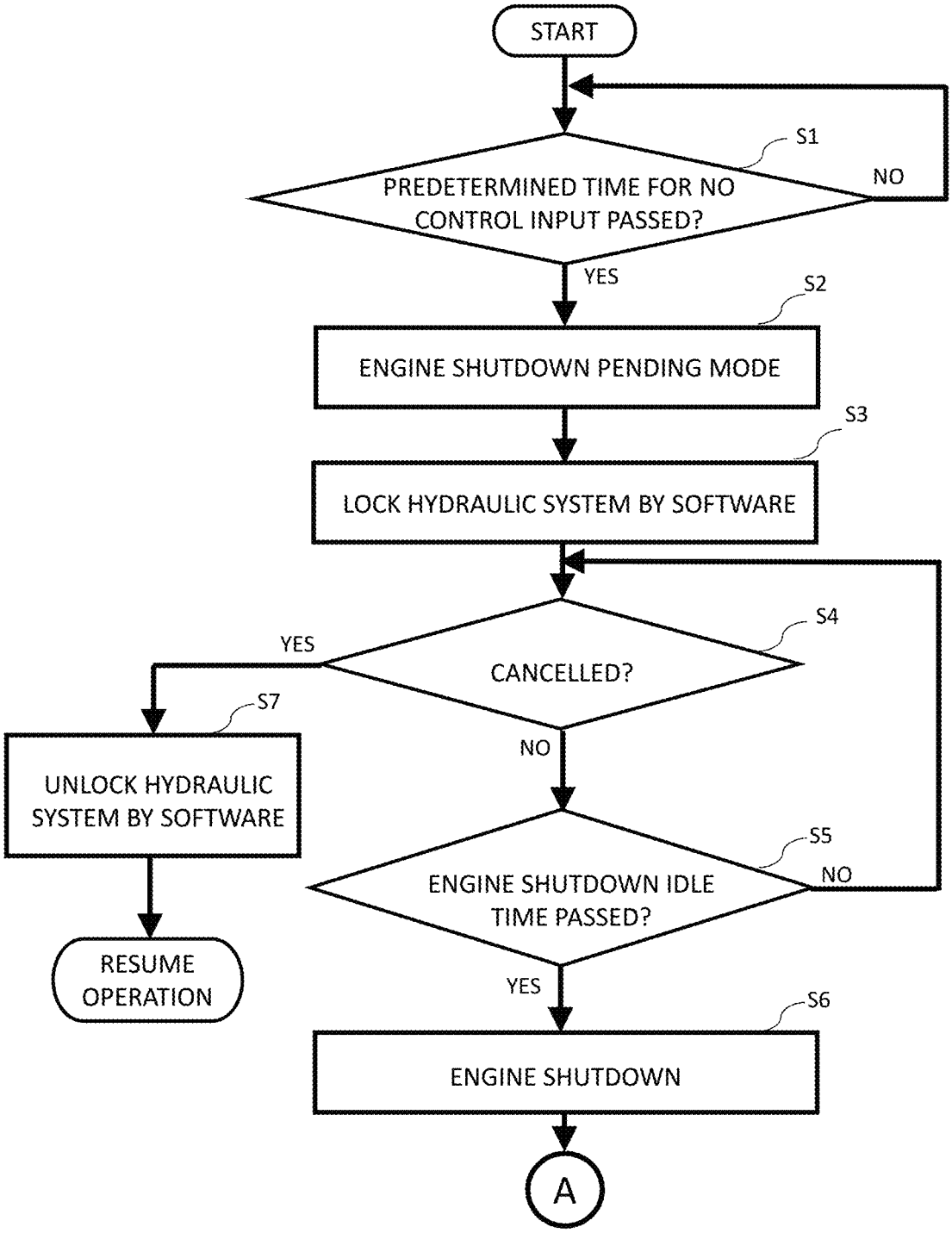
FIG. 5 is a flowchart of a method according to one or more embodiments of the disclosed subject matter.

FIG. 5 is a flowchart of a method of controlling the idling stop operation of the engine 11, as discussed above, according to one or more embodiments of the disclosed subject matter.

The process of controlling the idling stop operation may be initiated when the work machine 1 is in an idle state while the engine 11 is turned on. As shown in FIG. 5, the controller 12 may determine whether a predetermined time has passed since the controller 12 detected a control input of the work machine 1 last time (S1). Practically the predetermined time may be set at any value within a range of 3 to 60 minutes, for instance, by the controller 12. Optionally, the controller 12 can detect the control input of the work machine 1 by the sensors 37, such as shown in FIG. 3.

Next, in the case where the determination of step S1 is YES, the controller 12 may perform a process of engine shutdown pending mode (S2). More specifically, the engine shutdown pending mode may be a preparation process of engine shutdown and the controller 12 may start counting time from the beginning of the engine shutdown pending mode to the present time as "engine shutdown idle time."

On the other hand, in the case where the determination of step S1 is NO, i.e., the controller 12 detects any predefined control input to the work machine 1 before the predetermined time passed, the processing may return to S1 of the processing shown in FIG. 5. For instance, the predefined control input to be detected at step S1 may be an operation input from the joystick lever 22, a foot pedal which may be installed in the cab 5 to move the work machine 1, or any other physical operation input via the operator input(s) 32.

Next, the controller 12 can lock the hydraulic system by software control regardless of the position of the lock lever 20 (S3). In particular, the controller 12 may transmit a lock signal of the hydraulic system to the actuator circuit 19 without receiving an input from the lock lever 20. Locking the hydraulic system by software can prevent the work machine 1 from moving unintentionally and ensure the safety. More practically, locking the hydraulic system by software may be implemented such that, regardless of the operation of the lock lever 20, a hydraulic lock solenoid in a pilot circuit of the hydraulic system of the work machine 1 is excited.

Next, the controller 12 can determine whether the engine shutdown process is canceled by the operator (S4). In particular, if the controller 12 detects an input indicating the cancellation of the idling stop operation from the operator via the operator interface 23, the controller 12 can determine that the engine shutdown process is canceled. For instance, the determination may be performed by showing a cancel message on the operator interface 23 so that the operator of the work machine 1 may select "cancel" to abort the idling stop operation.

Next, in the case where the determination of step S4 is NO, the controller 12 may determine whether the engine shutdown idle time has passed (S5). In particular, the controller 12 may determine whether the engine shutdown idle time since the start point of the engine shutdown pending mode to the present time exceeds a predetermined time (e.g., 20 seconds).

Next, in the case where the determination of step S5 is YES, the controller 12 may perform engine shutdown (S6). More specifically, the controller 12 may turn off the engine 11 regardless of the position of the start switch 17. By the process of the engine shutdown at S6, the work machine 1 may transit to a "Key ON state" that the engine key may indicate "ON" while the engine is stopped.

Figure 6:
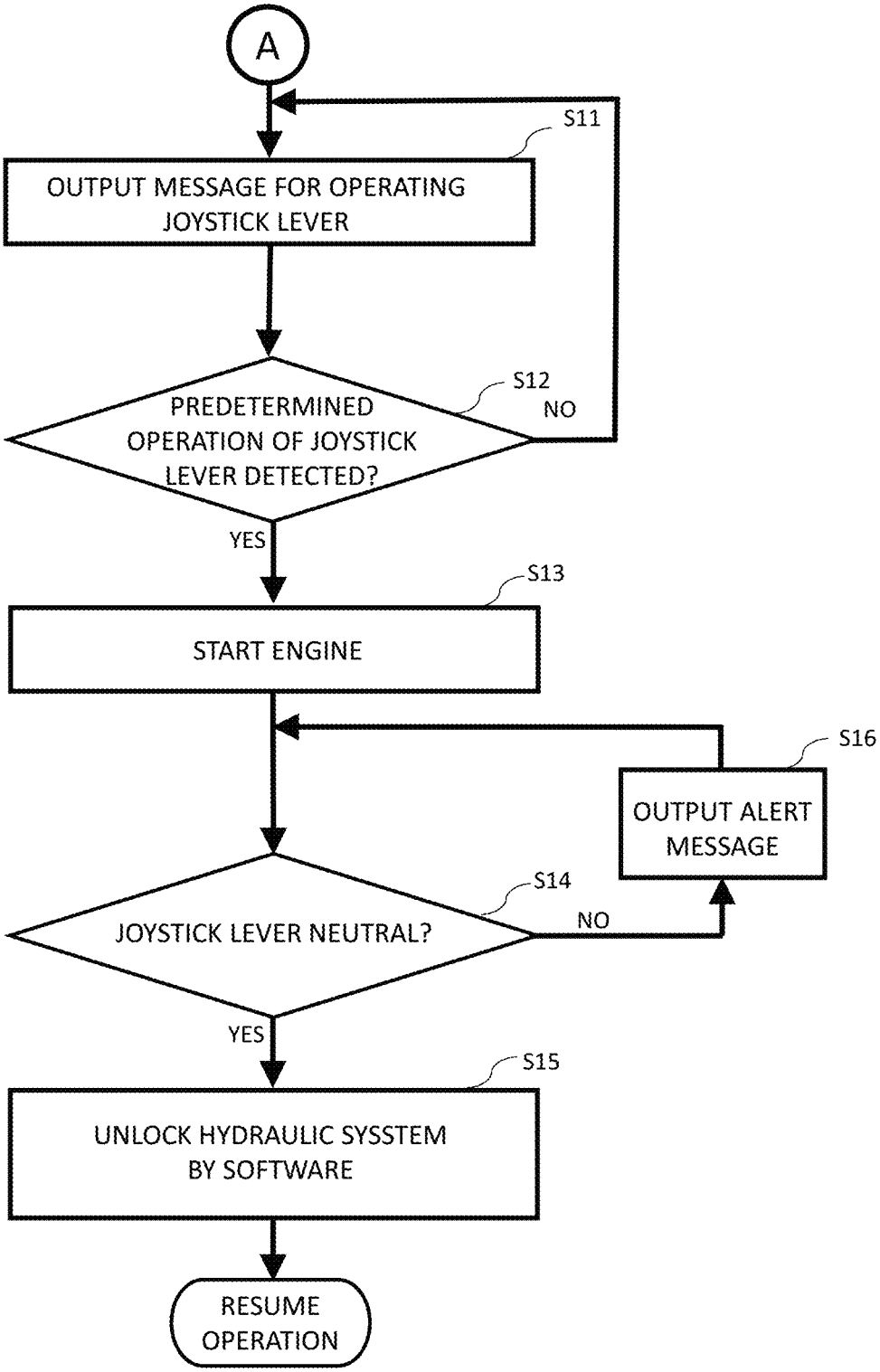
FIG. 6 is a flowchart of a method according to one or more embodiments of the disclosed subject matter.

Next, the processing may move on to step S11 of the processing shown in FIG. 6 (shown as A).

On the other hand, in the case where the determination of step S4 is YES, the processing may move on to step S7 of the processing shown in FIG. 5.

At step S7, the controller 12 may unlock the hydraulic system by software control regardless of the position of the lock lever 20 (S7). In particular, the controller 12 may transmit a lock release signal of the hydraulic system to the actuator circuit 19 without receiving an input from the lock lever 20. Subsequent to step S8, the processing may resume operation of the work machine 1. Optionally, the controller 12 may indicate on the operator interface 23 that the state of the work machine 1 has returned back to a normal operation. Particularly, in the normal operation, the engine 11 may started by a normal stating sequence using the Push-to-Start (PTS) button.

In the case where the determination of step S5 is NO, i.e., the engine shutdown idle time has not passed, the processing may return to S4 of the processing shown in FIG. 5.

FIG. 6 is a flowchart of controlling engine restart operation of the work machine 1 according to one or more embodiments of the disclosed subject matter. The processing shown in FIG. 6 may be performed subsequent to the processing of the engine shutdown (S6) described with reference to FIG. 5.

As shown in FIG. 6, the controller 12 may output to the operator of the work machine 1 a message to operate the joystick lever 22 (S11). More specifically, in step S11, the controller 12 may output guidance information or a message which instructs the operator to operate the joystick lever 22, via the operator interface 23, such as the display 35. Optionally or alternatively, the controller 12 may output the guidance information or the message which instructs the operator to operate the joystick lever 22 via the audio unit 36, such as a speaker.

Subsequent to step S11, the controller 12 may determine whether a predetermined operation of the joystick lever 22 by the operator of the work machine 1 is detected (S12). For instance, if the controller 12 detects that an input from either one of the set of two joystick levers 22 is more than 75% (i.e., tilt) for a predetermined amount of time (e.g., one second or more), the controller 12 may determine the input as the predetermined operation. According to one or more embodiments, only one of the two joystick levers 22 may be designated for the performance of the predetermined operation.

In the case where the determination of step S12 is YES, i.e., the controller 12 determines that the predetermined operation of the joystick lever 22 by the operator of the work machine 1 is detected, the controller 12 may start the engine 11 of the work machine 1 (S13). More specifically, the controller 12 may control to transmit the control signal to the governor controller 13 to start the engine 11. Since the engine 11 was previously running prior to being shut down, the starting of the engine 11 here may be referred to or characterized as restarting the engine 11.

In the case where the determination of step S12 is NO, i.e., the controller 12 determines that the predetermined operation of the joystick lever 22 by the operator of the work machine 1 is not detected, the processing may return to S11 of the processing shown in FIG. 6. More specifically, in the case that the controller 12 may detect another operation by the operator which is different from the predetermined operation of the joystick lever 22 by the operator, at step S12, the processing may return to S11 of the processing shown in FIG. 6. On the other hand, in the case that the controller 12 may not detect any operation by the operator for a predetermined time at step S12, the controller 12 may control the work machine 1 to shutdown to for protecting the battery.

Next, the controller 12 may determine whether the joystick lever 22 is in a neutral position (S14). In particular, the controller 12 may detect each position of the set of two joystick levers 22 by the sensors 37. More specifically, at step S14, the controller 12 may detect all operator inputs 32 (e.g., the joystick lever 22, a foot pedal, etc.) should be in the neutral position for safety.

In the case where the determination of step S14 is YES, i.e., the controller 12 determines that the joystick lever 22 is in the neutral position, the controller 12 may unlock the hydraulic system by software (S15). In particular, the controller 12 may transmit a lock release signal of the hydraulic system to the actuator circuit 19 without receiving an input from the lock lever 20. Subsequently to step S15, the processing may resume operation of the work machine 1. Optionally, the controller 12 may indicate on the operator interface 23 that the state of the work machine 1 returns back to a normal operation.

In the case where the determination of step S14 is NO, i.e., the controller 12 determines that the joystick lever 22 is not in the neutral position, the controller 12 may output an alert message to the operator of the work machine 1 (S16). More specifically, in step S16, the controller 12 may output alert information or an alert message which indicates that the joystick lever 22 is not in the neutral to the operator, via the operator interface 23, such as the display 35. Optionally or alternatively, the controller 12 may output the alert information or the alert message which indicates that the joystick lever 22 is not in the neutral to the operator via the audio unit 36, such as a speaker. Subsequently to step S16, the processing may return to S14 of the processing shown in FIG. 6.

Figure 7:
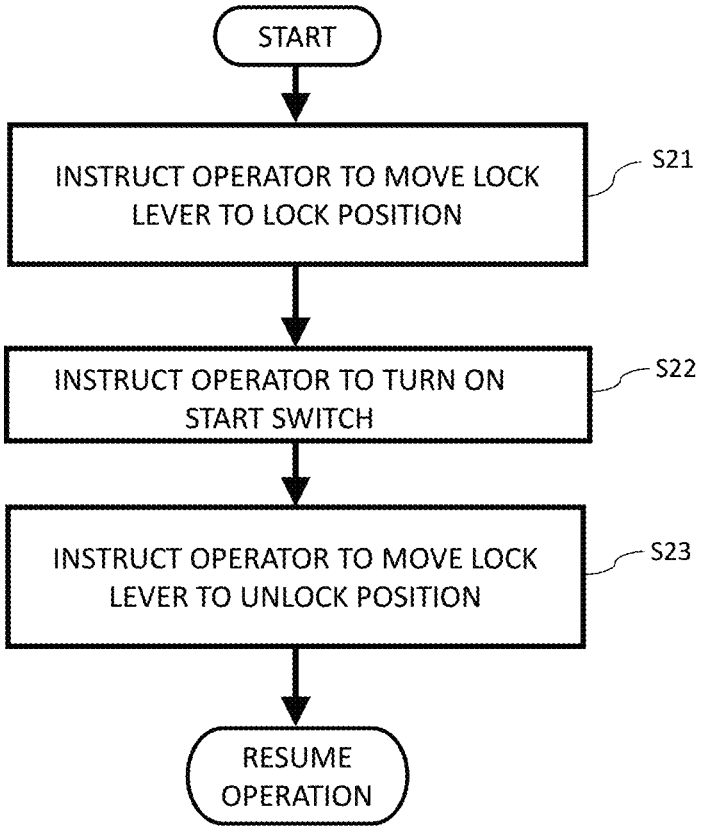
FIG. 7 is a flowchart of a method according to one or more embodiments of the disclosed subject matter.

FIG. 7 is a flowchart of controlling manual engine restart of the work machine 1 according to one or more embodiments of the disclosed subject matter. The processing shown in FIG. 7 may be performed in case that the operator of the work machine 1 may start the engine 11 in a normal situation.

The controller 12 may instruct the operator to move the lock lever 20 to the lock position (S21). More specifically, in step S21, the controller 12 may output guidance information or a message which instructs the operator to move the lock lever 20 to the lock position, via the operator interface 23, such as the display 35. Optionally or alternatively, the controller 12 may output the guidance information or the message which instructs the operator to move the lock lever 20 to the lock position, via the audio unit 36, such as a speaker.

Next, in response to an input of the lock lever 20 from the operator, the controller 12 may instruct the operator to turn on the start switch 17 to restart the engine 11 of the work machine 1 (S22). More specifically, in step S22, the controller 12 may output guidance information or a message which instructs the operator to turn on the start switch 17, via the operator interface 23, such as the display 35. Optionally or alternatively, the controller 12 may output the guidance information or the message which instruct the operator to turn on the start switch 17, via the audio unit 36, such as a speaker.

Next, in response to an input of the start switch 17 from the operator, the controller 12 may instruct the operator to move the lock lever 20 to the unlock position (S23). More specifically, in step S23, the controller 12 may output guidance information or a message which instructs the operator to move the lock lever 20 to the unlock position, via the operator interface 23, such as the display 35. Optionally or alternatively, the controller 12 may output the guidance information or the message which instructs the operator to move the lock lever 20 to the unlock position, via the audio unit 36, such as a speaker.

Subsequent to step S23, the processing may resume operation of the work machine 1. Optionally, the controller 12 may indicate on the operator interface 23 that the state of the work machine returns to a normal operation.

Figure 8:
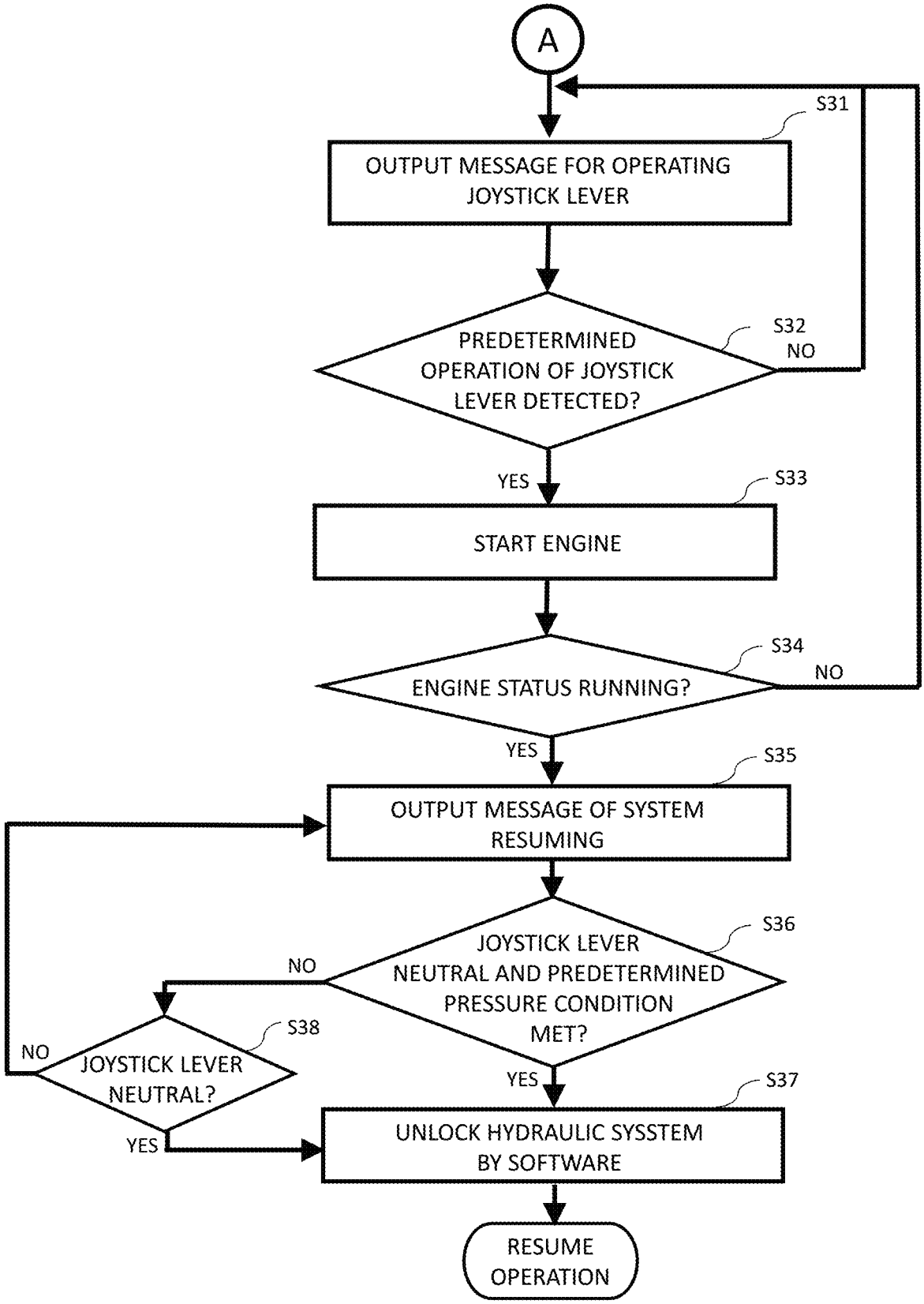
FIG. 8 is a flowchart of a method according to one or more embodiments of the disclosed subject matter.

FIG. 8 is a flowchart of controlling engine restart operation of the work machine 1 according to one or more embodiments of the disclosed subject matter. More practically, FIG. 8 is a flowchart of controlling engine restart operation of the work machine 1 further including determination of hydraulic pressure condition, according to one or more embodiments of the disclosed subject matter. The processing shown in FIG. 8 may be performed subsequent to the processing of the determination of the position of the lock lever 22 during the idling stop operation (S7) described with reference to FIG. 5, as an alternative embodiment from the processes shown in FIG. 6.

As shown in FIG. 8, the controller 12 may output to the operator of the work machine 1 a message to operate the joystick lever 22 (S31). Step S31 may be substantially same with step S11 shown in FIG. 6. More specifically, in step S31, the controller 12 may output guidance information or a message which instructs the operator to operate the joystick lever 22, via the operator interface 23, such as the display 35. Optionally or alternatively, the controller 12 may output the guidance information or the message which instructs the operator to operate the joystick lever 22 via the audio unit 36, such as a speaker.

Subsequent to step S31, the controller 12 may determine whether a predetermined operation of the joystick lever 22 by the operator of the work machine 1 is detected (S32). Step S32 may be substantially same with step S12 shown in FIG. 6. For instance, if the controller 12 detects that an input from either one of the set of two joystick levers 22 is more than 75% (i.e., tilt) for a predetermined amount of time (e.g., one second or more), the controller 12 may determine the input as the predetermined operation. According to one or more embodiments, only one of the two joystick levers 22 may be designated for the performance of the predetermined operation.

In the case where the determination of step S32 is YES, i.e., the controller 12 determines that the predetermined operation of the joystick lever 22 by the operator of the work machine 1 is detected, the controller 12 may start the engine 11 of the work machine 1 (S33). More specifically, the controller 12 may control to transmit the control signal to the governor controller 13 to start the engine 11. Since the engine 11 was previously running prior to being shut down, the starting of the engine 11 here may be referred to or characterized as restarting the engine 11.

In the case where the determination of step S32 is NO, i.e., the controller 12 determines that the predetermined operation of the joystick lever 22 by the operator of the work machine 1 is not detected, the processing may return to S31 of the processing shown in FIG. 8. More specifically, in the case that the controller 12 may detect another operation by the operator which is different from the predetermined operation of the joystick lever 22 by the operator, at step S32, the processing may return to S31 of the processing shown in FIG. 8. On the other hand, in the case that the controller 12 may not detect any operation by the operator for a predetermined time at step S32, the controller 12 may control the work machine 1 to shutdown to for protecting the battery.

Next, the controller 12 may determine whether the status of the engine 11 is running or not (S34). In particular, the controller 12 may detect a signal from the engine 11 to check the status of the engine 11.

In the case where the determination of step S34 is NO, i.e., the controller 12 determines that the status of the engine 11 is not "running", the processing may return to S31 of the processing shown in FIG. 8.

In the case where the determination of step S34 is YES, i.e., the controller 12 determines that the status of the engine 11 is not "running", the controller 12 may output a message that the system is resuming on the operator interface 23 (S35). More specifically, in step S35, the controller 12 may output alert information or a message which indicates that the that the system is resuming via the operator interface 23, such as the display 35. Optionally or alternatively, the controller 12 may output the information or the message which indicates that the that the system is resuming, via the audio unit 36, such as a speaker.

Next, the controller 12 may determine whether the joystick lever 22 is in a neutral position and whether a predetermined condition of hydraulic pump pressure is satisfied (S36). In particular, the controller 12 may detect each position of the set of two joystick levers 22 by the sensors 37. More specifically, at step S36, the controller 12 may detect all operator inputs 32 (e.g., the joystick lever 22, a foot pedal etc.) should be in the neutral position for safety. Also, at step S36, the controller 12 may determine whether a hydraulic pump pressure of the hydraulic system of the work machine 1 exceeds a predetermined value. In this embodiment, the determination of the predetermined condition of hydraulic pump pressure may be performed for securing a minimum release pressure for a swing parking brake of the swing upper body 2 when unlocking the hydraulic lock after engine restart process.

In the case where the determination of step S36 is YES, i.e., the controller 12 determines that the joystick lever 22 is in the neutral position and the predetermined condition of hydraulic pump pressure is satisfied, the controller 12 may unlock the hydraulic system by software (S37).

In particular, the controller 12 may transmit a lock release signal of the hydraulic system to the actuator circuit 19 without receiving an input from the lock lever 20. Subsequent to step S37, the processing may resume operation of the work machine 1. Optionally, the controller 12 may indicate on the operator interface 23 that the state of the work machine 1 returns back to a normal operation.

In the case where the determination of step S36 is NO, i.e., the controller 12 may determine whether the joystick lever 22 is in a neutral position for a predetermined time period (e.g., 0.2 second) (S38). In the case where the determination of step S38 is YES, i.e., the controller 12 determines that the joystick lever 22 is in the neutral position for the predetermined time period, the processing may go to step S37.

In the case where the determination of step S38 is NO, i.e., the controller 12 determines that the joystick lever 22 is not in the neutral position for the predetermined time period, the processing may return to step S35.

As described above, the processing may further include determination of hydraulic pressure condition for safety, according to one or more embodiments of the disclosed subject matter.

It is noted that embodiments of the disclosed subject matter are not limited to the specific arrangement of the processing steps as shown in FIGS. 5-8. For instance, embodiments of the disclosed subject matter can add more processing steps to control idling stop operation and restart of the engine 11 of the work machine 1.

As a result of the embodiments, a work machine can perform the idling stop operation and the engine restart operation, by a combination of software control of the lock lever for the hydraulic system and a predetermined operation of the joystick lever, to satisfy the safety condition and usability of the work machine.

Thus, according to embodiments of the disclosed subject matter, a work machine can comprise a joystick to control a movement of the work machine, a lock lever to control a hydraulic system of the work machine, a display to output information to an operator inside the work machine, and processing circuitry. The processing circuitry can be configured to lock the hydraulic system without receiving an input from the lock lever, perform an idling stop operation of an engine of the work machine, output, on the display, an instruction for the operator to operate the joystick lever to restart the engine of the work machine, detect a predetermined operation of the joystick, perform an engine restart operation, under a condition that the predetermined operation of the joystick is detected, and unlock the hydraulic system without receiving the input from the lock lever.

The work machine can perform the idling stop operation and the engine restart operation, by a combination of software control of the lock lever for the hydraulic system and a predetermined operation of the joystick lever, to satisfy the safety condition and usability of the work machine.

Moreover, the work machine can restart the engine after the idling stop operation without operating the start switch of the engine under a certain condition. It can contribute to increase the usability.

Moreover, the work machine can determine a predetermined condition of a hydraulic pump pressure, in addition to a position of a joystick lever.

In another aspect, a method for a work machine is disclosed or implemented. The method can comprise outputting, on a display of the work machine, an instruction for an operator to operate an operation lever to restart the engine of the work machine, after an idling stop operation, the operation lever controlling movement of the work machine, detecting a predetermined operation of the operation lever, while a hydraulic system being locked without a first input to the lock lever, the first input being a first physical input to lock the hydraulic system by the lock lever, performing an engine restart operation, determining that the operation lever is in a neutral position, and unlocking the hydraulic system without a second input from the lock lever, the second input being a second physical input to unlock the hydraulic system by the lock lever.

And in another aspect a non-transitory computer-readable storage medium is disclosed or provided. The non-transitory computer-readable storage medium can comprise computer executable instructions, wherein the instructions, when executed by an information processing system of a work machine, cause the information processing system to perform a method, the method comprising, locking a hydraulic system without a first mechanical input, performing an idling stop operation of an engine of a work machine, determining a predetermined operation of an operation lever in response to output information an instruction for an operator to operate the operation lever to restart the engine of the work machine, performing an engine restart operation, under a condition that the predetermined operation of the operation lever is determined, and unlocking the hydraulic system without a second mechanical input.

While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

The invention claimed is:

1. A work machine comprising:

a joystick to control a movement of the work machine;

a lock lever to control a hydraulic system of the work machine;

a display to output information to an operator inside the work machine; and processing circuitry configured to lock the hydraulic system without receiving an input from the lock lever, perform an idling stop operation of an engine of the work machine, output, on the display, an instruction for the operator to operate the joystick lever to restart the engine of the work machine, in a case that the lock lever is in an unlocked position during the idling stop operation, detect a predetermined operation of the joystick, perform an engine restart operation, under a condition that the predetermined operation of the joystick is detected, and with the lock lever in a lock position and with the engine restarted, unlock the hydraulic system without receiving the input from the lock lever.

2. The work machine according to claim 1, wherein the processing circuitry is further configured to determine whether the joystick is in a neutral position, and wherein the processing circuitry is configured to unlock the hydraulic system without receiving the input from the lock lever, under a condition that the joystick is in the neutral position.

3. The work machine according to claim 2, wherein the processing circuitry is configured to determine whether a hydraulic pump pressure exceeds a predetermined value, in addition to determination whether the joystick is in the neutral position, and wherein the processing circuitry is configured to unlock the hydraulic system without receiving the input from the lock lever, under both of the condition that the joystick is in the neutral position and a condition that the hydraulic pump pressure exceeds a predetermined value.

4. The work machine according to claim 1, wherein the predetermined operation of the joystick is an input to the joystick for a period of a predetermined time.

5. The work machine according to claim 1, wherein the processing circuitry is configured to stop outputting the instruction for the operator to operate the joystick to restart the engine of the work machine, in a case that the processing circuitry detects the lock lever in a locked position.

6. The work machine according to claim 5, wherein the processing circuitry is configured perform a manual engine restart operation, after stop outputting the instruction for the operator to operate the joystick, the manual engine restart operation including outputting instruction on the display to turn on a start switch of the engine by the operator.

7. The work machine according to claim 1, wherein the processing circuitry is configured to transmit a lock signal to the hydraulic system regardless of a position of the lock lever, to lock the hydraulic system without receiving the input from the lock lever.

8. The work machine according to claim 1, wherein the processing circuitry is configured to transmit a lock release signal to the hydraulic system regardless of a position of the lock lever, to unlock the hydraulic system without receiving the input from the lock lever.

9. The work machine according to claim 1, wherein the predetermined operation of the joystick is a tilt of the joystick by a predetermined amount or more for at least a predetermined period of time.

10. The work machine according to claim 1, wherein the work machine comprises a set of two joysticks as the joystick, and wherein the processing circuitry is configured to perform the engine restart operation, under the condition that the predetermined operation of at least one of the set of two joystick is detected.

11. A method for controlling a work machine having an engine comprising:

performing a software lock of a hydraulic system regardless of a lock lever to lock and unlock the hydraulic system being in either an unlocked state or a locked state;

with the software lock on the hydraulic system, shutting down the engine based on an idling stop procedure and regardless of a position of a start switch to start the engine;

under a first condition where the lock lever is in the locked state, performing a normal starting sequence of the engine using the start switch; and under a second condition where the lock lever is in the unlocked state:

outputting, on a display of the work machine, an instruction for an operator to operate an operation lever to restart the engine of the work machine, after an idling stop operation, the operation lever controlling movement of the work machine;

determining that a lock lever is unlocked while a hydraulic system being locked without a first input to the lock lever, the first input being a first physical input to lock the hydraulic system by the lock lever, detecting a predetermined operation of the operation lever;

performing an engine restart operation;

determining that the operation lever is in a neutral position; and unlocking the hydraulic system without a second input from the lock lever, the second input being a second physical input to unlock the hydraulic system by the lock lever.

12. The method according to claim 11, wherein the predetermined operation of the operation lever is an input to the operation lever for a period of a predetermined time.

13. The method according to claim 11, further comprising:

outputting alert information, on the display, under a condition of detection that the operation lever is not in the neutral position.

14. The method according to claim 11, wherein the operation lever is a joystick lever.

15. A non-transitory computer-readable storage medium including computer executable instructions, wherein the instructions, when executed by an information processing system of a work machine, cause the information processing system to perform a method, the method comprising:

locking a hydraulic system without a first mechanical input;

performing an idling stop operation of an engine of a work machine;

determining a predetermined operation of an operation lever in response to output information an instruction for an operator to operate the operation lever to restart the engine of the work machine;

performing an engine restart operation, under a condition that the predetermined operation of the operation lever is determined; and with a lock lever to lock and unlock the hydraulic system in a lock position and with the engine restarted, unlocking the hydraulic system in response to a transmitted lock release signal and without a second mechanical input.

16. The non-transitory computer-readable storage medium according to claim 15, wherein the first mechanical input is an input by the lock lever to lock the hydraulic system.

17. The non-transitory computer-readable storage medium according to claim 15, wherein the second mechanical input is an input by the lock lever to unlock the hydraulic system.

18. The non-transitory computer-readable storage medium according to claim 15, wherein the operation lever is a joystick.

19. The non-transitory computer-readable storage medium according to claim 18, wherein the predetermined operation of the joystick is a tilt of the joystick by a predetermined amount or more for at least a predetermined period of time.

20. The non-transitory computer-readable storage medium according to claim 18, wherein the operation lever is a set of two joysticks, and wherein performing the engine restart operation is performed, under the condition that the predetermined operation of at least one of the set of two joysticks is determined.

* * * * *